US005158036A

United States Patent [19]

Stoddard et al.

[11] Patent Number: 5,158,036

[45] Date of Patent: Oct. 27, 1992

[54] BOAT WINDOW BOOTS

[76] Inventors: Willis J. Stoddard, 331 131st Ave. NE., Bellevue, Wash. 98005; George Spector, 233 Broadway RM 3815, New York, N.Y. 10007

[21] Appl. No.: 740,322

[22] Filed: Jul. 19, 1991

[51] Int. Cl.[5] ..... B63B 17/00

[52] U.S. Cl. ..... 114/361

[58] Field of Search ..... 114/343, 361

[56] References Cited

U.S. PATENT DOCUMENTS 3,810,267 5/1974 Fussell, Jr. ..... 114/361

4,586,451 5/1986 Mori ..... 114/343

5,029,549 7/1991 Armando ..... 114/361

*Primary Examiner*—Sherman Basinger

[57] ABSTRACT

A corner safety boot for a windshield on a bowrider boat is provided and consists of a resilient triangular shaped pocket member to fit over a sharp corner of the windshield after an opening center section of the windshield is pivoted to one side. The pocket member will protect a passenger walking therethrough. A retainer strap connects the pocket member to the bowrider boat to prevent loss when not in use.

3 Claims, 1 Drawing Sheet

BOAT WINDOW BOOTS

BACKGROUND OF THE INVENTION

The instant invention relates generally to corner guards and more specifically it relates to a corner safety boot for a windshield on a bowrider boat which provides protection to a passenger from a sharp corner on the windshield when the center section is opened.

There are available various conventional corner guards which do not provide the novel improvments of the invention herein disclosed.

SUMMARY OF THE INVENTION

A primary object of the present invention is to provide a corner safety boot for a windshield on a bowrider boat that will overcome the shortcomings of the prior art devices.

Another object is to provide a corner safety boot for a windshield on a bowrider boat that includes a pocket member which will protect a passenger from a sharp corner on the windshield when the center section is opened to allow the passenger to walk through to seating in the open bow.

An additional object is to provide a corner safety boot for a windshield on a bowrider boat, whereby the corner of the windshield will cause a bumper to extend out of the tip end of the pocket member of the safety boot when the safety boot is installed thereon for additional protection for the passenger.

A further object is to provide a corner safety boot for a windshield on a bowrider that is simple and easy to use.

A still further object is to provide a corner safety boot for a windshield on a bowshield boat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
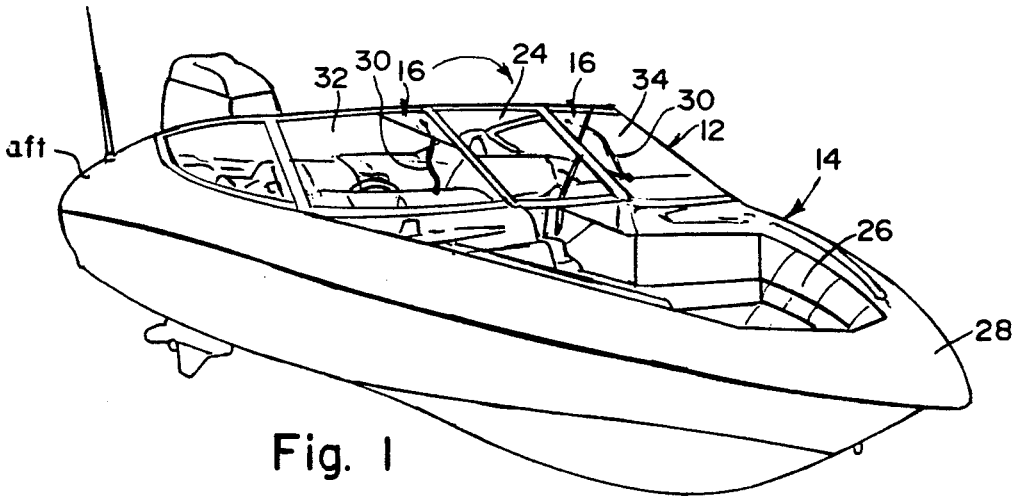
FIG. 1 is a perspective view of a bowrider boat with the invention installed on the windshield.

Turning now descriptively to the drawings, in which similar reference characters denote similar elements throughout the several views, the Figures illustrate a corner safety boot 10 for a windshield 12 on a bowrider boat 14. The conrner safety boot 10 consists of a resilient triangular shaped pocket member 16 having an aperture 18 opposite its tip end 20. It is sized to fit over a sharp corner 22 of the windshield 12 after an opening center section 24 of the windshield 12 is pivoted to one side. The pocket member 16 will protect a passenger from the sharp corner 22, when the passenger walks therethrough to a seat 26 in an open bow 28 of the bowrider boat 14.

Figure 2:
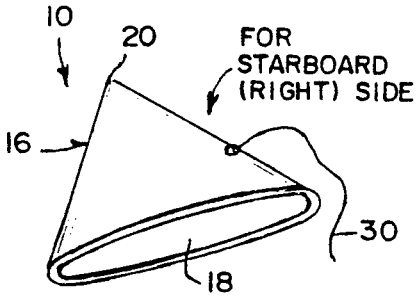
FIG. 2 is a perspective view of a starboard (right) safety boot.
Figure 3:
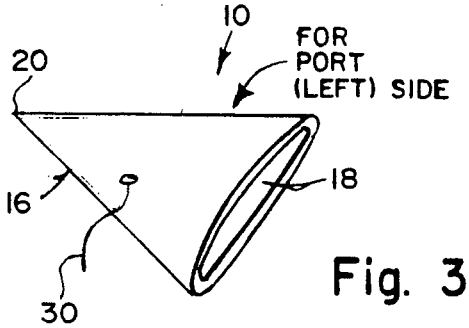
FIG. 3 is a perspective view of a port (left) safety boot.

A retainer strap 30 is connected between the pocket member 16 and the bowrider boat 14 so as to prevent the loss of the pocket member 16 when not in use. For best results, two corner safety boots 10 should be used, one as best seen in FIG. 2, for the starboard (right) side panel 32 and the other being slightly thicker, as best seen in FIG. 3, for the port (left) side panel 34 of the windshield 12.

The pocket member 16 is fabricated out of a preformed soft cushioning foam material, such as rubber, plastic or the like, so as to snugly mater with the sharp corner 22 of the windshield 12.

Figure 4:
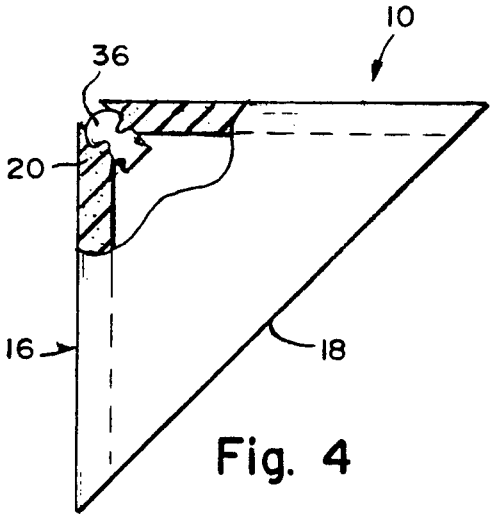
FIG. 4 is a plan view with parts broken away of a modification showing a bumper within the tip end of the pocket member of the safety boot.
Figure 5:
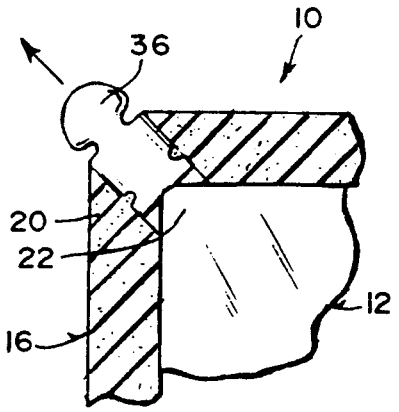
FIG. 5 is a cross sectional view of a portion of the modification whereby the corner of the windshield causes the bumper to extend out of the tip end of the pocket member of the safety boot when installed thereon.

As shown in FIGS. 4 and 5, the conrner safety boot 10 further can include a bumper 36 carried in the tip end 20 of the pocket member 16, whereby the corner 22 of the windshield 12 will cause the bumper 36 to extend out of the tip end 20 of the pocket member 16 of the safety boot 10, when the safety boot is installed thereon for additional protection for the passenger.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A corner safety boot for a boat windshield, said corner safety boot comprising a resilient triangular shaped pocket member having an aperture opposite its tip end and sized to fit over a sharp corner of the windshield, whereby said pocket member will protect a passenger from the sharp corner, further including means mounted in the tip end of said pocket member whereby said means is forced outwardly of said tip end responsive to mounting providing further protection for a passenger engaging said pocket member.

2. A safety boat as recited in claim 1, wherein said means is movable relative the tip end of said boot.

3. A safety boot as recited in claim 1, wherein said tip end has an aperture with a bumper slidably mounted in said aperture adapted to be engaged by the windshield corner when the boot is mounted thereon to be forced outwardly of said aperture for better passenger safety.

* * * * *